US005824962A

United States Patent [19]

Katsuma

[11] Patent Number: 5,824,962

[45] Date of Patent: Oct. 20, 1998

[54] SEALING RUBBER PLUG WITH INTERPOSING BAND UNDER THE INSULATION BARREL OF A WIRE TERMINAL

[75] Inventor: Takatoshi Katsuma, Yokkaichi, Japan

[73] Assignee: Sumitomo Wiring Systems, Ltd., Yokkaichi, Japan

[21] Appl. No.: 877,893

[22] Filed: Jun. 18, 1997

Related U.S. Application Data

[63] Continuation of Ser. No. 523,548, Sep. 5, 1995, abandoned.

[30] Foreign Application Priority Data

Sep. 8, 1994 [JP] Japan ..... 6-242319

[51] Int. Cl.[6] ..... H01B 17/00

[52] U.S. Cl. ..... 174/135; 439/587; 174/84 C

[58] Field of Search ..... 439/587, 589, 439/274, 275, 279; 174/65 SS, 65 G, 503, 166 R, 93, 84 C, 192, 74 R, 176, 178, 180

[56] References Cited

U.S. PATENT DOCUMENTS

| | | | |
|---|---|---|---|
| 1,343,251 | 6/1920 | Dillon | 403/278 |
| 1,343,877 | 6/1920 | Waltman | 285/389 |
| 1,995,407 | 3/1935 | Walker | 174/74 R |
| 2,024,862 | 12/1935 | Hooley | 174/100 |
| 3,040,121 | 6/1962 | Gillemot | 174/93 |
| 4,705,915 | 11/1987 | Van Brunt et al. | 174/35 R |
| 5,519,170 | 5/1996 | Nabeshima | 174/74 R |
| 5,532,433 | 7/1996 | Endo et al. | 174/84 C |
| 5,540,450 | 7/1996 | Hayashi et al. | 277/205 |

FOREIGN PATENT DOCUMENTS

| | | | |
|---|---|---|---|
| A-0 424 892 | 5/1991 | European Pat. Off. . | |
| A-0 520 291 | 12/1992 | European Pat. Off. . | |
| 632557 A1 | 1/1995 | European Pat. Off. | 174/74 R |
| 48910 | 9/1938 | France | 174/65 SS |
| 1-39206 | 9/1989 | Japan | 174/84 C |
| 5-2382 | 1/1993 | Japan . | |
| A-2 272 804 | 5/1994 | United Kingdom . | |

OTHER PUBLICATIONS

Aluminum Joining Processes for the Electrical Industry, 1968, p. 8, 1968.

*Primary Examiner*—Kristine L. Kincaid
*Assistant Examiner*—Kamand Cuneo
*Attorney, Agent, or Firm*—Oliff & Berridge, PLC.

[57] ABSTRACT

A rubber plug is configured to be clamped to a wire without damaging the rubber plug. An insulation barrel is clamped to a clamping surface of the rubber plug, thereby retaining the rubber plug against withdrawal from the wire. An interposing ring is interposed between the insulation barrel and the rubber plug when the insulation barrel is clamped so that side edges of the insulation barrel will not bite into and damage the rubber plug.

16 Claims, 4 Drawing Sheets

SEALING RUBBER PLUG WITH INTERPOSING BAND UNDER THE INSULATION BARREL OF A WIRE TERMINAL

This is a Continuation of application Ser. No. 08/523,548 filed Sep. 5, 1995 now abandoned.

BACKGROUND OF THE INVENTION

1. Field of the Invention

This invention relates to a sealing rubber plug-fixing structure and a method for clamping a rubber plug to a wire.

2. Background of Related Art

A waterproof connector is used in environments requiring waterproof sealing. When a wire, having a metal terminal connected thereto, is to be inserted into a housing, a rubber plug for sealing purposes is fitted on the wire. Upon insertion, a watertight seal is formed between an inner wall surface of the housing and ring-shaped seal lips formed on and projecting from the outer periphery of the sealing rubber plug (see FIG. 11). This conventional rubber plug 50 includes a first portion having seal lips 51 that perform a sealing function, and a second portion 55 is adapted to be fixed to the sheathed wire 52. More specifically, an insulation barrel 54 of the metal terminal 53 is forcibly deformed to embrace the rubber plug over the entire periphery of the sheathed wire 52, thereby fixing the rubber plug to the wire 52.

The force of clamping between the rubber plug and the metal terminal is provided by a clamping force applied by the insulation barrel. Therefore, the withdrawal of the rubber plug can be prevented merely by increasing the clamping force. However, the entire metal terminal is formed by blanking, and opposite side edges of the insulation barrel are defined by cut surfaces, thereby defining sharp edges. Therefore, when clamping is effected, the sheath of the wire may be partially cut, which would adversely affect the sealing function. This can be avoided by lowering the clamping force to such an extent that the biting of the edges into the sheath will not occur. However, if this is done, the originally-intended clamping function would be adversely affected.

SUMMARY OF THE INVENTION

The present invention has been made in view of the above problems, and an object of the invention is to provide a sealing rubber plug-fixing structure that prevents withdrawal of a sealing rubber plug from a metal terminal without damaging the rubber plug.

According to a first aspect of the invention, there is provided a sealing rubber plug-fixing structure in which a sealing rubber plug fitted on an end portion of a sheathed wire is fixedly clamped to the wire by a metal terminal. The rubber plug is fixedly clamped with an interposing member interposed between the rubber plug and the metal terminal.

The interposing member may have a ring-shape so as to fit on an outer peripheral surface of the rubber plug. In this event, the interposing member may have an interrupting groove formed at a portion thereof for allowing the interposing ring to be inwardly contracted in a radial direction.

According to a second aspect of the invention, there is provided a waterproof seal comprising a body section having a sealing portion and a fixing portion adjacent the sealing portion, and an interposing member surrounding the fixing portion.

According to a third aspect of the invention, there is provided a method for fixedly securing a seal to a wire, the wire being connectable to a connector having an insulation barrel. The method comprises surrounding a fixing surface of the seal with an interposing member, and clamping the interposing member with the insulation barrel.

During assembly, the wire is passed through a wire insertion hole in the rubber plug, and the metal terminal is forcibly deformed with the interposing member interposed between the rubber plug and the metal terminal so that the rubber plug is indirectly clamped and fixed. Additionally, the interposing member can be easily contracted radially inwardly when the rubber plug is clamped so that a uniform tightening force can be applied to the rubber plug over its entire periphery. Accordingly, the rubber plug is fixedly clamped with the interposing member interposed between the rubber plug and the metal terminal. Therefore, even if the clamping force applied by the metal terminal is increased, the rubber plug will not be damaged and the sealing property can be maintained. If the interrupting groove is provided, the interposing member can be easily contracted radially inwardly so that the rubber plug can be uniformly clamped, thus achieving a good tightened condition.

These and other advantages will be described in or apparent from the following detailed description of preferred embodiments.

BRIEF DESCRIPTION OF THE DRAWINGS

Preferred embodiments will be described with reference to the following drawings, in which.

DETAILED DESCRIPTION OF PREFERRED EMBODIMENTS

Figure 1:
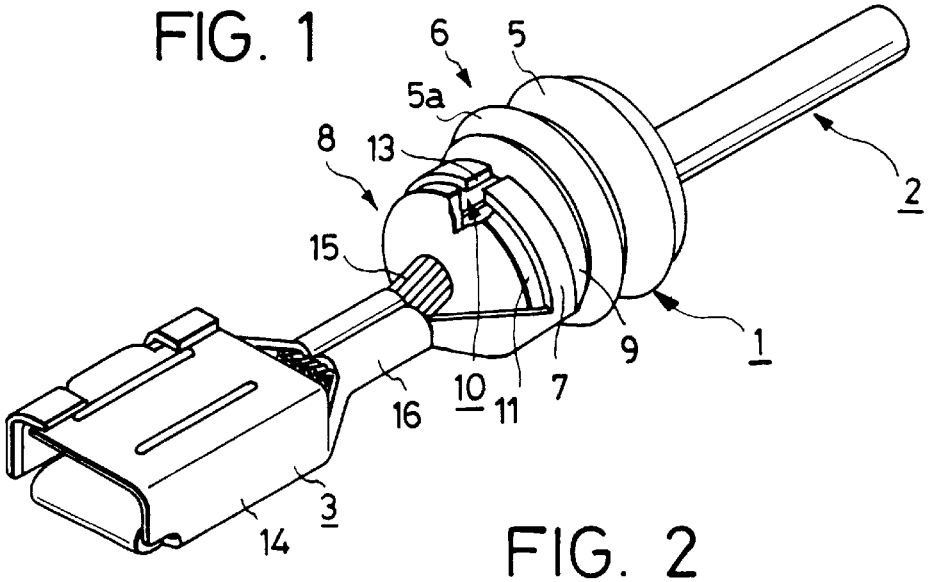
FIG. 1 is a perspective view of a first embodiment of the present invention.

A first preferred embodiment of the present invention will now be described with reference to FIGS. 1 to 3.

A rubber plug 1 is fitted on a front end portion of a sheath of a wire 2, and is clamped thereto by a metal terminal 3. In this condition, the rubber plug 1 is inserted into a cavity in a connector (not shown) to form a seal between the cavity and the wire 2.

Reference is first made to the rubber plug 1 in detail. As shown in FIG. 2, the rubber plug 1 has a cylindrical shape as a whole, and is integrally molded of a rubber material having a suitable degree of elasticity. The rubber plug 1 has a wire insertion hole 4 formed therethrough along an axis thereof for passing the sheathed wire 2 therethrough. An outer peripheral surface of one side portion (the right side portion in FIG. 2) of the rubber plug 1 defines a seal region 6 on which two outer seal lips 5*a*,5 are formed. An outer peripheral surface of the other side portion (the left side portion in FIG. 1) defines a fixing region 8 that is adapted to be fixedly clamped to the wire by an insulation barrel 7 of the metal terminal 3.

The rubber plug 1, when inserted into the cavity, is elastically deformed by an inner peripheral surface of the cavity, and is held in pressurized contact therewith, thereby maintaining the interior of the cavity in a watertight condition. The seal lip 5*a* that is closer to the fixing region 8 has at one end a stopper surface 9 formed over an entire circumference thereof in perpendicular relation to the axis of the rubber plug 1, as shown in FIG. 3. Another stopper surface 12 is formed on the rubber plug in perpendicular relation to the axis of the rubber plug, and is spaced a predetermined distance from the stopper surface 9 in opposed relation thereto. The two stopper surfaces 9 and 12 cooperate with each other to limit the displacement of an interposing ring (interposing member) 10 and the insulation barrel 7 in the axial direction, as more fully described below.

The stopper surface 12 at the fixing region 8 is defined by an inner surface of a withdrawal prevention flange 11 formed on and extending radially outwardly from the front end of the fixing region 8 over an entire circumference thereof. The outer peripheral surface extending between the two stopper surfaces 9 and 12 defines a clamping surface 8*a* that can be compressively grasped by the insulation barrel 7. The distance between the two stopper surfaces 9 and 12 is slightly larger than the width of the interposing ring 10 and the width of the insulation barrel 7. In this example, the stopper surface 12 at the fixing region 8 is slightly smaller in diameter than the other stopper surface or annular extension 9, and the radially-outward dimension of the stopper surface 12 is larger than the sum of the thicknesses of the interposing ring 10 and insulation barrel 7, as shown in FIG. 3.

Figure 2:
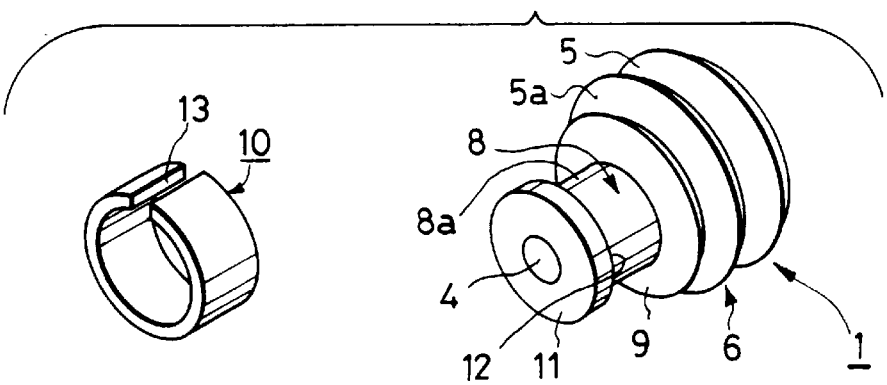
FIG. 2 is a perspective view illustrating an interposing member and plug of the first embodiment.
Figure 3:
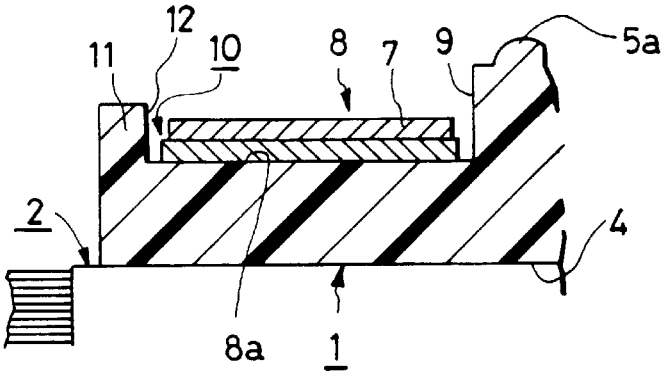
FIG. 3 is an enlarged, cross-sectional view illustrating a portion of the first embodiment.

Before the insulation barrel 7 is forcibly deformed, the interposing ring 10 shown in FIG. 2 is provisionally fitted on the fixing region 8. In this embodiment, the interposing ring 10 is made of a soft resin, and has an interrupting slit 13 extending parallel to the axis thereof. With this construction, although the inner diameter of the interposing ring 10 is normally smaller than the outer diameter of the clamping surface 8*a*, the interposing ring 10 can be forcibly expanded to resiliently fit on the clamping surface 8*a*. The width of the interposing ring 10 is slightly larger than that of the insulation barrel 7, and the interposing ring 10 has an elasticity that allows the insulation barrel 7 to bite thereinto, depending on the degree of deformation of the insulation barrel 7, thereby limiting the displacement of the insulation barrel 7 in the axial direction.

As shown in FIG. 1, the metal terminal 3 includes a connection portion 14 formed at its front end for receiving a mating metal terminal (not shown) and a wire barrel 16 disposed rearwardly of the connection portion for clamping an exposed portion of a conductor 15 of the sheathed wire 2. The insulation barrel 7 is disposed rearwardly of the wire barrel 16. In the blanking of the metal terminal 3, a pair of arms of the insulation barrel 7 extends substantially perpendicularly to the axis of the metal terminal 3, and are symmetrical with respect to the axis. The insulation barrel 7 has a sufficient length to fully embrace the entire outer periphery of the interposing ring 10 fitted on the fixing region 8 of the rubber plug 1.

The operation of this embodiment will now be described. The wire 2 is passed through the wire insertion hole 4 in the rubber plug 1, and the rubber plug 1 is positioned at the front end portion of the sheath of the wire. In this condition, the conductor is clamped by the wire barrel 16. Before or after the clamping operation, the interposing ring 10 is forcibly expanded, and is provisionally fitted on the clamping surface 8*a* of the fixing region 8. Then, the insulation barrel 7 is forcibly deformed to embrace the interposing ring 10.

When the insulation barrel 7 is thus forcibly deformed, the interposing ring 10 is deformed into a smaller diameter so that the clamping surface 8*a* is tightly grasped indirectly by the insulation barrel. In this case, depending on the degree of clamping force, the insulation barrel 7 bites into the interposing ring 10. Therefore, the insulation barrel is more positively secured to the interposing ring 10, thereby preventing relative axial displacement between the two. Moreover, the two stopper surfaces 9 and 12 limit the axial displacement of the insulation barrel 7 and the interposing ring 10 so that the insulation barrel 7 is prevented from disengagement from the rubber plug 1.

In this case, even if the insulation barrel 7 has sharp edges, these edges only bite into the interposing ring 10 and will not come into direct contact with the rubber plug 1. Therefore, the sealing property of the rubber plug 1 can be maintained without damaging the rubber plug 1.

Only those portions of a second embodiment of the invention different from the above first embodiment will now be described with reference to FIGS. 4 and 5.

Figure 4:
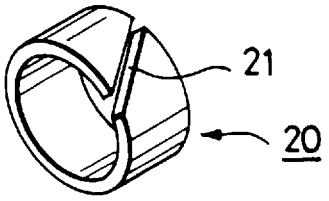
FIG. 4 is a perspective view of an interposing member of a second embodiment.
Figure 5:
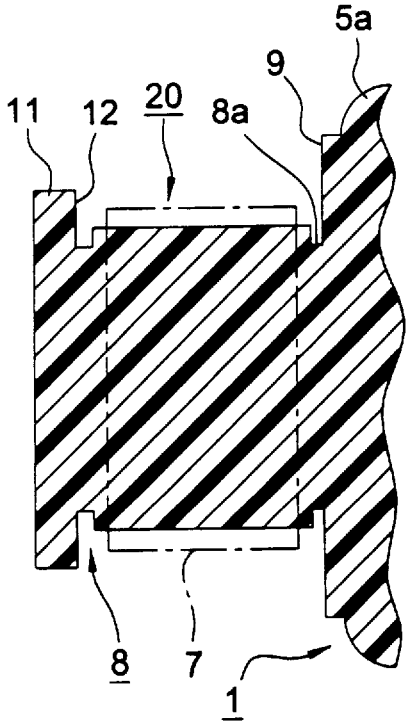
FIG. 5 is an enlarged, top plan view illustrating the interposing member of the second embodiment.

In this embodiment, an interposing ring 20 has an interrupting groove 21 extending an at angle with respect to the axis of this ring, as shown in FIG. 4. If the interrupting groove 21 is formed along the axis, a gap could be formed between opposed ends of the interposing ring 20, thus forming an area on which the clamping force applied from the insulation barrel is not exerted. However, because the interrupting groove 21 is formed obliquely, such a gap is not formed over the entire periphery, and therefore the clamping force is applied to the rubber plug 1 uniformly over the entire periphery. This prevents the withdrawal of the rubber plug 1 more positively.

Figure 6:
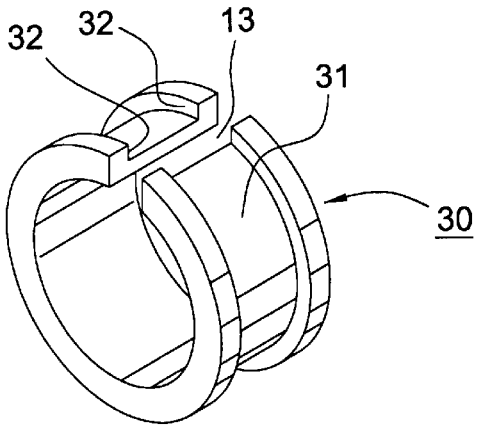
FIG. 6 is a perspective view of an interposing member of a third embodiment.
Figure 7:
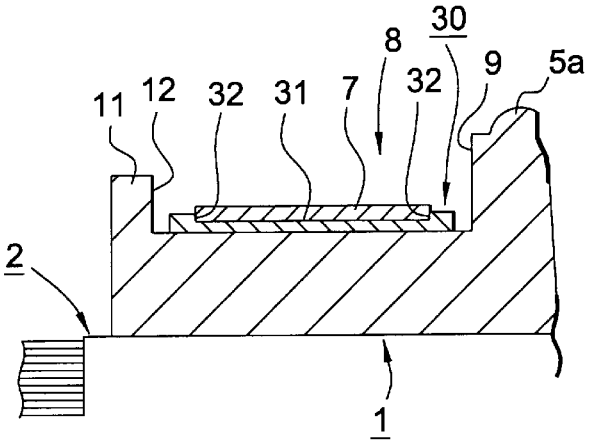
FIG. 7 is an enlarged, cross-sectional view illustrating a portion of the third embodiment.

Only those portions of a third embodiment of the invention different from the above first embodiment will now be described with reference to FIGS. 6 and 7.

In this embodiment, means for preventing axial displacement of the insulation barrel 7 is provided directly on an interposing ring 30. More specifically, a pair of retaining flanges 32 are formed respectively on opposite ends of an outer surface of the interposing ring 30 over an entire periphery thereof, and are directed radially outwardly. The outer peripheral surface extending between the two retaining flanges 32 defines a clamping surface 31 that can be compressively grasped by the insulation barrel 7.

In the third embodiment, the retaining flanges 32 prevent the insulation barrel 7 from being axially displaced, either to the right or to the left, on the interposing ring 30. Therefore, the displacement of the insulation barrel 7 is prevented during the forcible deformation of the barrel so that the clamping operation can be carried out smoothly.

Figure 8:
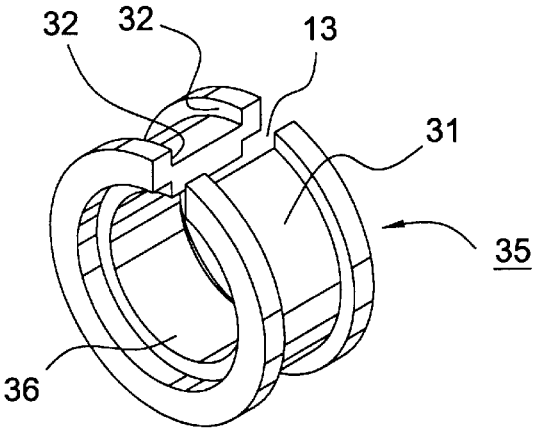
FIG. 8 is a perspective view of an interposing member of a fourth embodiment.
Figure 9:
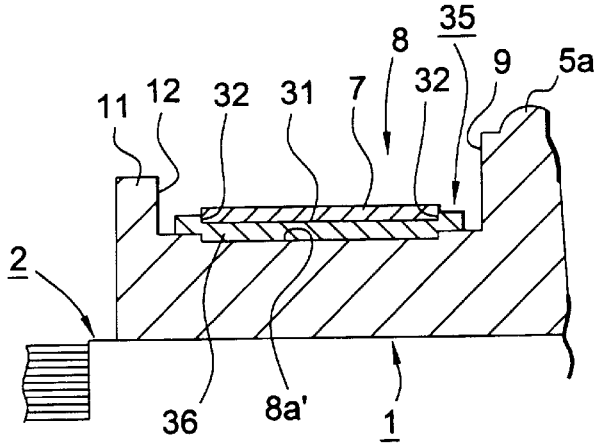
FIG. 9 is an enlarged, cross-sectional view of a portion of the fourth embodiment.

Only those portions of a fourth embodiment different from the above third embodiment will now be described with reference to FIGS. 8 and 9.

In this embodiment, a retaining recess 31 and retaining surfaces 32 are formed on an outer peripheral surface of an interposing ring 35 as in the third embodiment. In addition, a retaining convex portion 36 is formed on an inner peripheral surface of the interposing ring 35 over an entire circumference thereof, the convex portion 36 being disposed centrally of the width of the interposing ring 35. The width of the retaining convex portion 36 is generally equal to the width of the insulation barrel 7, and the convex portion 36 bites into the clamping surface 8*a* of the fixing region 8 when the insulation barrel is clamped relative to the rubber plug 1.

In the fourth embodiment, when the interposing ring 35 is provisionally fitted on the clamping surface 8*a* of the rubber plug 1, the retaining convex portion 36 of the interposing ring 35 slightly bites into the clamping surface 8*a* because of a resilient restoring force of ring 35, thereby slightly limiting the displacement of the interposing ring 35. Therefore, until the clamping is effected by the insulation barrel 7, the displacement is prevented, thus achieving an advantage that the clamping operation can be carried out smoothly.

Figure 10:
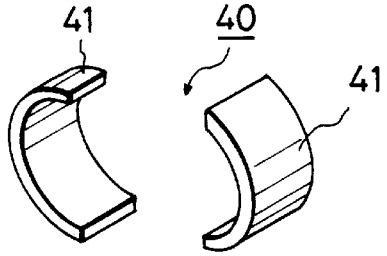
FIG. 10 is a perspective view of an interposing member of a fifth embodiment.
Figure 11:
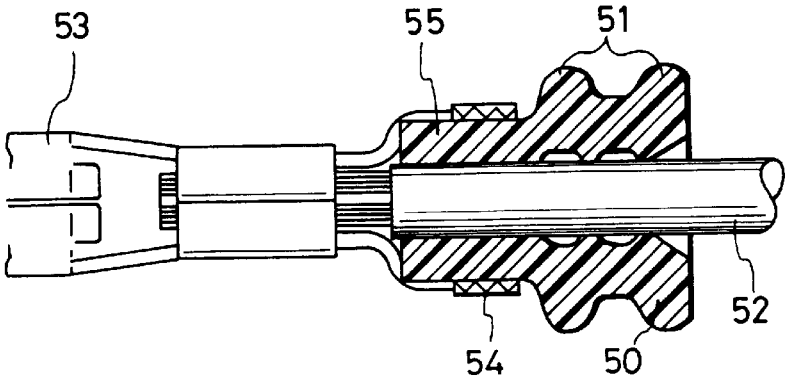
FIG. 11 PRIOR ART
FIG. 11 is a cross-sectional view of a conventional construction.

Only those portions of a fifth embodiment different from the above first embodiment will now be described with reference to FIG. 10.

In the fifth embodiment, an interposing ring 40 comprises a pair of ring pieces 41. The two ring pieces 41 correspond to those obtained by dividing the interposing ring 10 of the first embodiment into two sections symmetrical with respect to the axis of the ring. An inner diameter of the ring configuration formed by the oppositely-mated ring pieces 41 is slightly smaller than the outer diameter of the fixing region 8.

In the fifth embodiment, when the insulation barrel 7 is to be forcibly deformed, the two ring pieces 41 are first opposed to each other to surround the fixing region 8. When the insulation barrel 7 is forcibly deformed to embrace the ring pieces 41, the insulation barrel 7 is fixed in such a manner that the insulation barrel 7 slightly bites into the two ring pieces 41.

The interposing ring 40 in this embodiment is of the split type, and therefore the ring 40 is not required to have resiliency for allowing the fitting of the ring on the fixing region 8. Namely, the interposing ring does not need to be made of an elastic material, and therefore the degree of freedom of material choice can be increased.

The present invention is not to be limited to the above embodiments and, for example, the following modifications fall within the scope of the present invention.

(1) The interposing member may be made of any suitable material such as, for example, paper and vinyl, so long as the interposing member prevents the edges of the insulation barrel from coming into direct contact with the rubber plug. Also, the interposing member should not be made of a material that will damage the rubber plug when it is interposed between the rubber plug and the insulation plug.

(2) Furthermore, the interposing member may comprise a tape-like material wound on the rubber plug.

Having now described the invention, it will be apparent to those skilled in the art that many changes and modifications can be made without departing from the spirit or scope of the invention as set forth in the appended claims.

What is claimed is:

1. A sealing rubber plug-fixing structure in combination with a metal terminal for sealingly connecting a sheathed wire within a housing, comprising:

a sealing rubber plug fitted on an end portion of the sheathed wire, said sealing rubber plug defining a groove between two flanges;

an interposing member interposed between said two flanges; and said metal terminal including an insulation barrel, said insulation barrel clamping the interposing member and rubber plug to the sheathed wire, wherein each of the two flanges extends away to a radial extent from the sealing rubber plug that is greater than a radial extent that the interposing member extends away from the sealing rubber plug, so that the insulation barrel and interposing member will be retained within the groove.

2. A sealing rubber plug-fixing structure according to claim 1, wherein said interposing member has a ring-shape and is fittable on an outer peripheral surface of said rubber plug, said interposing member also having an interrupting groove formed at a portion thereof for allowing said interposing member to be inwardly contracted in a radical direction.

3. A waterproof seal for sealingly connecting a sheathed wire within a housing, comprising:

a body section having a sealing portion and a fixing portion adjacent the sealing portion, said fixing portion receiving a wire connector insulation barrel, said sealing portion configured to seal an interior of said housing; and an interposing member surrounding said fixing portion and including a seating surface receiving the wire connector insulation barrel, said interposing member protecting the fixing portion from damage from the wire connector insulation barrel and preventing the fixing portion from directly abutting against an edge of the wire connector insulation barrel.

4. A waterproof seal according to claim 3, wherein said fixing portion includes a fixing surface bounded by first and second stopper surfaces.

5. A waterproof seal according to claim 4, wherein said first stopper surface is defined by a flange located a remote distance from the sealing portion, and the second stopper surface is defined by an annular extension integrally formed with said sealing portion.

6. A waterproof seal according to claim 5, wherein a diameter of the flange is less than a diameter of the annular extension, the diameter of the flange being approximately twice as large as a thickness of the interposing member.

7. A waterproof seal according to claim 3, wherein said interposing member includes a slit that is flexibly expandable so as to allow the interposing member to fit over the fixing portion.

8. A waterproof seal according to claim 7, wherein said slit is formed at an angle with respect to an axis of the interposing member.

9. A waterproof seal according to claim 3, wherein said interposing member includes flanges that extend radially away from said fixing portion.

10. A waterproof seal according to claim 9, wherein said interposing member includes a convex portion having a diameter that is slightly less than a diameter of the seating surface of the interposing member, said convex portion biting into the fixing portion.

11. A waterproof seal according to claim 10, wherein said convex portion and said seating surface are formed on opposite sides of said interposing member.

12. A waterproof seal according to claim 3, wherein said interposing member includes a convex portion having a diameter that is slightly less than a diameter of a main surface of the interposing member, said convex portion biting into the fixing portion.

13. A waterproof seal according to claim 3, wherein said interposing member is a two-part structure including at least two half ring pieces each having an arc that substantially matches a corresponding portion of the fixing portion.

14. A waterproof seal according to claim 3, wherein said interposing member comprises tape-like material wrapped around said fixing portion.

15. A sealing rubber plug-fixing structure according to claim 1, wherein said interposing member is sized to fit underneath the metal terminal and configured to transmit uniform pressure from the metal terminal to a circumference of the sealing rubber plug to effect a waterproof seal between the sealing rubber plug and the sheathed wire.

16. A waterproof seal according to claim 3, wherein said interposing sized to fit underneath a metal terminal and configured to transmit uniform pressure from the metal terminal to a circumference of the fixing portion to effect a waterproof seal between the fixing portion and a sheathed wire to which the waterproof seal is connected.

* * * * *